US006796259B2

(12) United States Patent
Hood et al.

(10) Patent No.: US 6,796,259 B2
(45) Date of Patent: Sep. 28, 2004

(54) SAILBOAT ROTATABLE KEEL APPENDAGE

(76) Inventors: Frederick E. Hood, 231 Homestead La., Portsmouth, RI (US) 02871; Bernard Olcott, 62 Hackensack Plank Rd., Weekawken, NJ (US) 07086

( * ) Notice: Subject to any disclaimer, the term of this patent is extended or adjusted under 35 U.S.C. 154(b) by 0 days.

(21) Appl. No.: 10/226,701

(22) Filed: Aug. 23, 2002

(65) Prior Publication Data

US 2003/0106477 A1 Jun. 12, 2003

Related U.S. Application Data

(60) Provisional application No. 60/317,796, filed on Sep. 7, 2001.

(51) Int. Cl.[7] ..... B63B 3/38
(52) U.S. Cl. ..... 114/140
(58) Field of Search ..... 114/128, 140, 114/132

(56) References Cited

U.S. PATENT DOCUMENTS

| | | | | |
|---|---|---|---|---|
| 768,085 A | * | 8/1904 | Stromborg | 114/128 |
| 3,968,765 A | * | 7/1976 | Menegus | 114/39.29 |
| 4,280,433 A | * | 7/1981 | Haddock | 114/140 |
| 4,703,708 A | * | 11/1987 | Cohen | 114/141 |
| 5,313,905 A | | 5/1994 | Calderon | |
| 5,671,691 A | | 9/1997 | Birger | 114/162 |
| 6,349,659 B1 | | 2/2002 | Hood | 114/39.21 |

FOREIGN PATENT DOCUMENTS

| | | | | |
|---|---|---|---|---|
| GB | 1 567 395 | * | 5/1980 | |
| GB | 2 270 040 A | * | 3/1994 | |
| JP | 10090701 | | 10/1999 | B63H/25/44 |

* cited by examiner

*Primary Examiner*—Sherman Basinger
(74) *Attorney, Agent, or Firm*—Bernard Olcott

(57) ABSTRACT

For eliminating the dynamic drag of the member which supports the ballast by completely enveloping it with a indispensable component of the sailing vessel, namely, the hollow rotatable monolithic rigid hydrodynamic fin, and thereby reducing the dynamic drag of the canoe body when it is sailing. The elongated four-sided symmetrical diamond shaped ballast support is adapted to be fixed to the interior of the canoe body. The top of the rotatable fin enters into the interior of the canoe body so that the water turbulence is substantially less than in the prior art when the top of the rotatable fin is spaced from the bottom of the canoe body. With sliding convex/concave contact, the rotatable fin is laterally supported by the stationary diamond shaped member. A first and second cylinder are fixed to the canoe body sole and canoe body cabin top to provide strong support to the rotatable fin and ballast. An energy analysis explains how a reduction in the leeward drift will increase the forward speed of the canoe body.

10 Claims, 5 Drawing Sheets

SAILBOAT ROTATABLE KEEL APPENDAGE

CROSS-REFERENCE TO RELATED PATENT APPLICATIONS

This application incorporates by reference U.S. Provisional Application No. 60/317,796 and claiming the priority date of its filing date of Sep. 7, 2001.

FIELD OF THE INVENTION

This application relates to appendages for sailing vessels with heavy ballast bulbs as required for large sailing yachts such as International America's Cup Class (IACC) Yachts and in particular to rotatable fin keels for increasing their forward velocity by generating enhanced hydrodynamic forces and reducing drag so as to quicken the sailing vessel's passage to a windward destination.

DEFINITIONS

In this specification, the following terms have the following meanings: a "canoe body" is the hull of the vessel up to the sheer line excluding appendages; an "appendage" means an underwater protrusion from the underside of the canoe body such as a keel, fin, wing, dagger board, centerboard keel, rudder, etc. (the ballast bulb is not an appendage); "VMG" (Velocity Made Good) means the velocity of a tacking or reaching sailing vessel towards its windward destination; "leeward drift" means the drift to leeward of a tacking or reaching vessel caused by the wind; "appendage lift" means a force generated by a submerged moving appendage in the direction to counter the leeward drift by the wind of a tacking or reaching sailing vessel; "wetted surface" is any surface over which water passes; "drag" means the resistance of water passing over any submerged surface; "appendage or keel drag" means the resistance of water passing over wetted surfaces of a keel or an appendage; "water track" is the direction of the body of water moving towards and impinging upon a canoe body; "crabwise motion" of a canoe body means that it is moving into the water track with its longitudinal axis at an angle thereto; "crabwise hull drag" means the additional drag of the canoe body when it has crabwise motion; "making leeway" means that the keel or appendage is producing an asymmetrical effect to generate a hydrodynamic force vector having a component to counter the leeward drift; "angle of incidence or "leeway angle" means the angle between the longitudinal centerline of a fin or appendage and the water track; an "asymmetric effect" means the creation of a hydrodynamic force when the water track is split into two paths and then are reunited, one path of the water flow being longer than the other path of the water flow; a "symmetrical appendage" means an appendage having two opposite chord surfaces each with the same camber; "favorable wind shift" occurs when the apparent wind angle increases; "Lift/Drag Ratio" means the quantity of lift per unit of drag produced by a moving submerged fin, the goal being to generate maximum lift with minimum drag by increasing the lift and/or reducing the fin drag; and the Velocity Made Good (VMG) of a tacking or reaching vessel is the component of the sailing yacht's forward velocity vector which is directed towards the windward mark.

OBJECTS OF THE INVENTION

Skippers of racing yachts desire to win races and Skippers of cruising sailboats desire to shorten the time on tacking and reaching passages. Such goals can be favorably influenced with appendage design in accordance with the invention.

Naval Architects have been frustrated knowing that as little as increasing the forward yacht velocity by one half a knot will win races. One of the major problems is reducing the drag of the wetted surfaces of the ballast bulb support members.

It is a principal object of the invention not only to reduce the drag of the wetted ballast bulb support surfaces but to eliminate them.

Another object of the invention is to maintain desired leeway when the canoe body is turned directly into the water track.

Another object of the invention is to increase the Velocity Made Good (VMG) by eliminating the drag of the bow wave and reducing hull drag by eliminating crabwise motion of the yacht's hull when it is tacking.

Still another object of the invention is to increase the velocity by turning the canoe body away from the wind and directly into the water track to produce a favorable wind shift without reducing its desired leeway or lengthening the path to the windward mark by maintaining a desired angle of incidence of the fin keel to the water track.

BRIEF SUMMARY OF THE INVENTION

The rotatable fin and the fixed ballast bulb support are juxtapositioned to eliminate drag of the submerged fixed ballast support. While sailing, the submerged ballast support member has no wetted surface which would generate drag. A new and novel support structure fixed to the interior of the canoe body includes an elongated support member fixed to the canoe body which carries a heavy ballast bulb at its bottom end. A desirable thin hollow fin completely jackets the ballast support member and is rotatable thereabout to selective angular displacements from the longitudinal axis of the canoe body. The ballast support member is anchored to many regions in the interior of the canoe body to distribute large stresses and thus avoid destructive consequences. The rotatable fin extends upwardly into the interior of the canoe body to avoid water passage between the top of the fin and the underside of the canoe body. The ballast member is geometrically shaped as a four sided diamond to permit the required angular displacement of the fin while providing required high strength and great stiffness for the jacketed unit of the fin and ballast support member unit.

In addition to the fin reducing its leeward drift, its fin shape can increase the forward velocity of a tacking yacht as explained by the Law of Energy Transfers. Energy balance formulas are set forth to explain how the forward velocity of a tacking yacht is increased when its leeward drift is decreased by selectively shaping the fin for generating a desired asymmetrical effect about the fin.

DESCRIPTION OF THE DRAWINGS

The drawings are not drawn to scale. In the drawings, the shapes, locations and dimensions of component parts are exaggerated to better explain and emphasize the inventive concepts.

PRIOR ART

Figure 1:
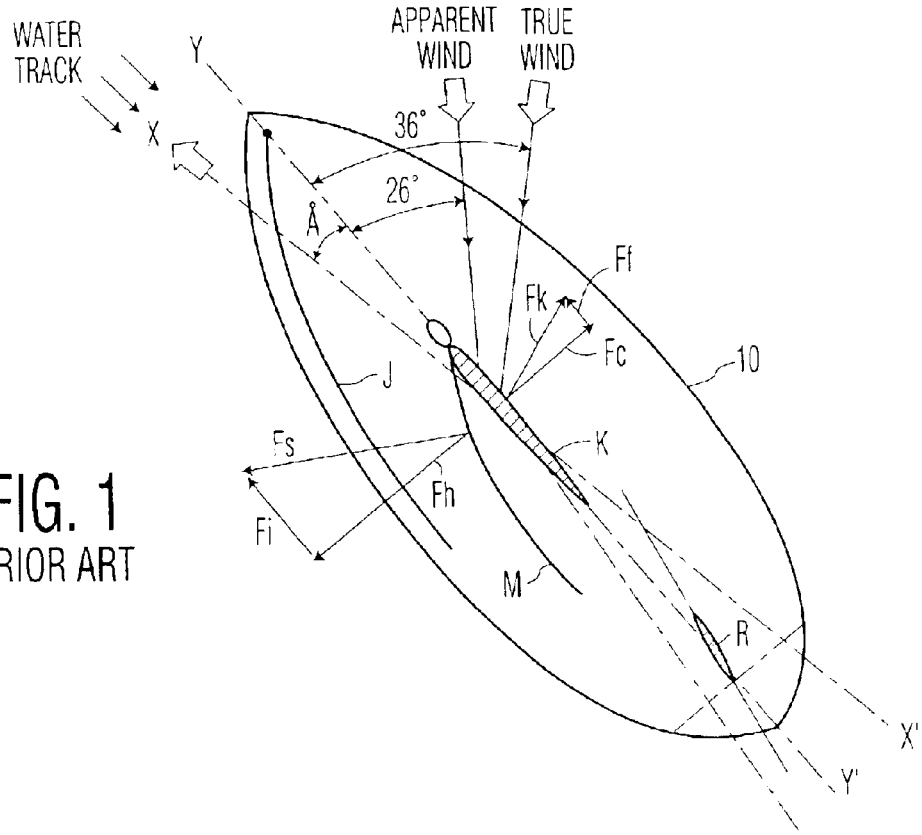
FIG. 1 PRIOR ART
FIG. 1 is a schematic diagram which illustrates the prior art wherein a windward tacking yacht on starboard tack is making leeway with a fixed fin keel and a fixed ballast bulb, both being fixed along the fore and aft axis of the canoe body.

As known in the prior art, FIG. 1 illustrates a canoe body 10 of a sailing vessel on starboard tack which is powered by the wind acting on its main sail M and jib J to generate a force Fs on the sails of canoe body 10 which has a component Fh to drift the canoe body 10 leewardly and a component Fi to propel the yacht forwardly. The tacking canoe body 10 has a symmetrical fin keel K fixed thereto along its longitudinal centerline. The canoe body and its fin keel K is angularly displaced from the water track by an angle Å so as to create a lift force Fk by an asymmetric effect having a component Fc to counter the leeward drift of the canoe body 10 caused by the wind force Fs with a component Fh acting upon the sails J and M. The drag of the canoe body in FIG. 1 is greater than the drag in FIG. 2 because in FIG. 1 the canoe body is not "arrowing" directly into the on-rushing water track and is moving in a crabwise motion. Further, in FIG. 1, the on-rushing water track forms a drag producing wave on its port bow when the yacht is on starboard tack due to the large mass of water that the entire port side of the hull has to push aside. On port tack, the bow wave appears on the starboard bow.

Inventive Advancement in the Art

Figure 2:
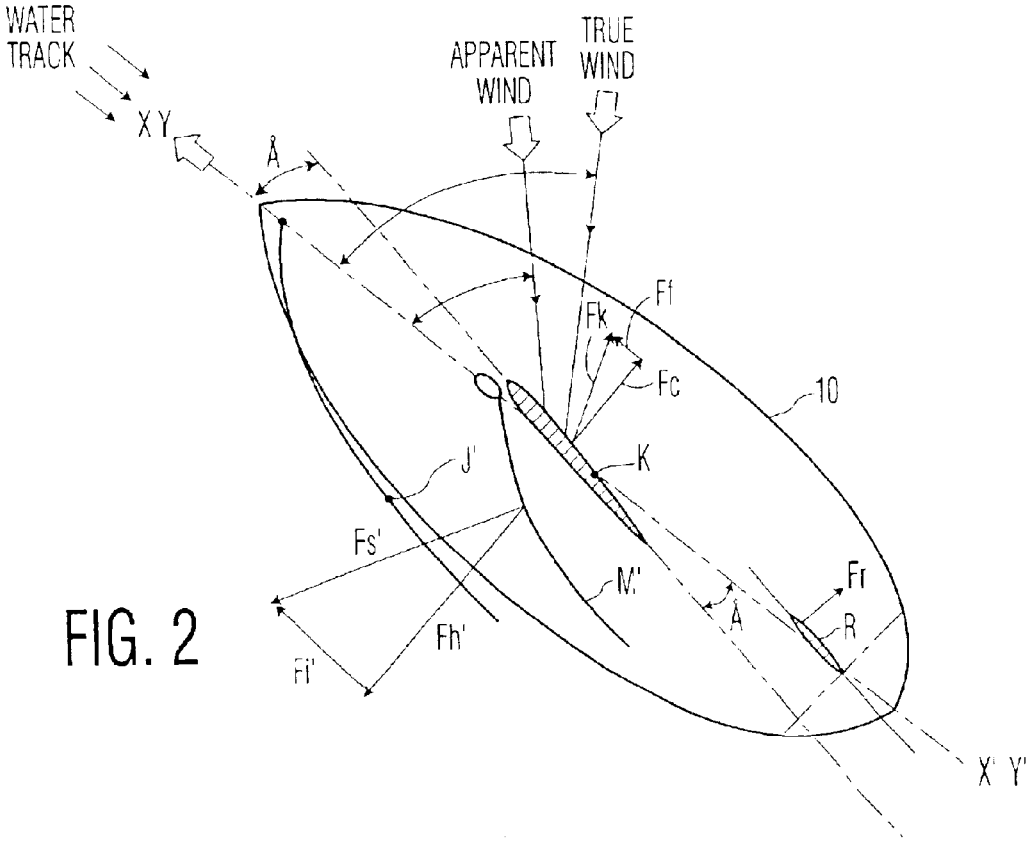
FIG. 2 is a schematic diagram according to the invention of a windward sailing yacht having a rotatable fin on starboard tack pointing directly into the water track. The fin and its angle A degrees to the water track in FIG. 2 is the same as the angle A degrees of the fin in FIG. 1.

FIG. 2 is a schematic diagram of a tacking vessel in which the canoe body is steered directly into the water track and the fin keel K (the fin 18 in FIGS. 3, 4, 4A and 5) is selectively rotated about a vertical axis on the longitudinal centerline of the canoe body.

In FIG. 2, there is no bow wave nor crabwise motions of the canoe body 10 and the drag of the ballast bulb is reduced because it has zero incidence to the water track.

Comparing the hydrodynamic forces in FIG. 2 with FIG. 1, each have the same canoe body 10, each have the same shaped symmetrical fin K and each have the same favorable generated hydrodynamic force vector Fk because each have the same fin K, each have the same angle of incidence Å to the water track and each have the keel lift force vectors Fk with a component Fc which is counter to and reduces the leeward drift of the canoe body produced by the wind force Fh. When the generated keel lift force vector Fk favorably tilts towards the bow, in accordance with the Energy Balance Formula (2), supra, Fk will also have a forward component force vector Ff to increase the yacht's forward velocity produced by the component Fi of the wind force Fs.

Comparing the wind forces in FIG. 2 with FIG. 1, the angle of the apparent wind to the longitudinal axis YY' of the canoe body in FIG. 2 is increased by Å degrees as a result of turning the bow of the canoe body away from the apparent wind by A degrees. This causes Fs' (the wind force) and Fi' (the component of Fs' which forwardly propels the canoe body) in FIG. 2 to be greater than Fs and Fi in FIG. 1 after skilled adjustments are made to the trim of the jib, the trim of the main sail and adjustments are made to the traveler for reshaping the main sail from M to M' and the jib sail from J to J'.

FIG. 2 and the embodiments of the invention shown in FIGS. 3, 4, 4A and 5 illustrate improvements over the tacking prior art sailing yacht in FIG. 1 by: (a) eliminating crabwise motion and the port bow wave of the canoe body to reduce canoe body drag of the yacht in FIG. 1, (b) producing the equivalent of a favorable wind shift without lengthening the path to the windward mark, (c) reducing ballast drag by pointing the ballast bulb directly into the water track while making leeway with an angularly displaced rotatable fin having an angle of incidence to the water track and (d) eliminating the wetted surface of the ballast support by jacketing it with the rotatable fin.

Energy Balance

FIG. 1 illustrates a tacking yacht 10 making leeway as its keel K creates an asymmetrical effect to generate hydrodynamic forces Fk, Fc and Fh. When yacht 10 is pointed directly into the water track the fin K is not making leeway, it does not create an asymmetrical effect, the force vectors Fk and Fc are zero and the wind drift force Fh on the sails leewardly drifts the canoe body a distance of Yh feet per unit time. The wasted drift energy per unit of time is therefore Fh×Yh. When the fin K is making leeway as shown in FIG. 2, the hydrodynamic keel lift force is Fk and is assumed to be 25% of the wind leeward drift force Fh. The net wind drift force is 0.75 Fh and the canoe body leeward drift distance Yh is reduced to 0.75 Yh which results from the 25% reduction in the leeward wind drift force Fh. Accordingly, the wasted leeward wind drift energy Fh×Yh is reduced to 0.75 Fh×0.75 Yh, or 56% of what it was prior to the asymmetric effect by the fin keel K. However, the potential saved energy of 44% (100%−56%) is not completely achievable to forwardly propel the canoe body because of the energy losses by induced keel drag, keel downwash, keel tip vortex, turbulence, etc. and the entropy losses which occurs at each energy transfer.

The First and Second Laws of Thermodynamics are not violatable and must be observed. The two Laws are:

First Law. Energy can neither be created nor destroyed. Energy can only be transferred, and Second Law. All transfers of energy are made with energy loss which explains one reason why perpetual motion can not be achieved. The measure of this loss in every energy interchange is quantitatively expressed by the thermodynamic term "Entropy" as the index of unavailability of energy.

The only source of energy for a vessel under sail in currentless water is the wind energy which can only be transferred and not be destroyed in accordance with the First Law.

The theory of Energy Balance, infra, explains how the forward velocity of a tacking sailing vessel in FIG. 2 is increased by a fin keel K generating an asymmetrical effect according to the invention while the canoe body 10 is pointed directly into the water track.

Energy Balance when the Yacht is Sailing Downwind

When the yacht is sailing directly downwind, the energy of the wind is transferred to the sails (with some entropy loss) and the energy from the sails is transferred to the hull by way of the mast, shrouds, stays and sheets (with more entropy losses at each transfer). The wind energy "We" is transferred to the hull to provide: (a) energy "Fe" to propel the yacht forwardly, (b) the wasted energy of hull drag "He", (c) the wasted energy of the keel drag "Ke" and (d) the unavoidable entropy loss "Te" due to the energy transfers.

The Energy Balance for a yacht sailing downwind is:

$$We=Fe+He+Ke+Te \quad (1),$$

where

- We=Energy of the wind transferred to the canoe body
- Fe=Energy of the wind which forwardly propels the sailing vessel
- He=Energy wasted by drag of the hull
- Ke=Energy wasted by drag of the keel
- Te=Total Entropy lost energy by all the energy transfers

Energy Balance when the Yacht is Tacking

The Energy Balance for the tacking yacht in FIG. 2 is:

$$We=(Fe+Fe')+(Le-Le')+He+Ke+Te-Ebs-Ebw-Ecw \quad (2),$$

where

- We=Energy of the wind transferred to the canoe body,
- Fe=Energy of the wind which forwardly propels the sailing vessel when the canoe body is pointing at an angle to the apparent wind,
- Fe'=Incremental energy available to increase the forward velocity of the canoe body with the energy saved when the leeward drift of the canoe body is reduced,
- Le=Energy wasted by the canoe body drifting leewardly by the wind when the keel is not making leeway,
- Le'=Leeward drift energy wasted by the canoe body drifting leewardly when the keel is making leeway,
- He=Energy wasted by drag of the canoe body when it is not pointing into the water track and tacking,
- Ke=Keel induced wasted drag when it is making leeway,
- Ebs=Energy saved when the support members of the ballast bulb has no wetted surfaces
- Ebw=Energy saved when the bow wave is eliminated
- Ecw=Energy saved when the canoe body has no crabwise motion
- Te=Total Entropy lost energy by the energy transfers when the keel is making leeway, whereby the forward velocity of the canoe body is increased when:(a) the leeward drift of the canoe body is reduced by the asymmetric effect of the fin; (b) the energy saved of Ebw+Ecw occurs as the canoe body is pointed directly into the water track; and (c) the support members of the ballast bulb have no wetted surfaces.

Preferred Embodiment

Figure 3:
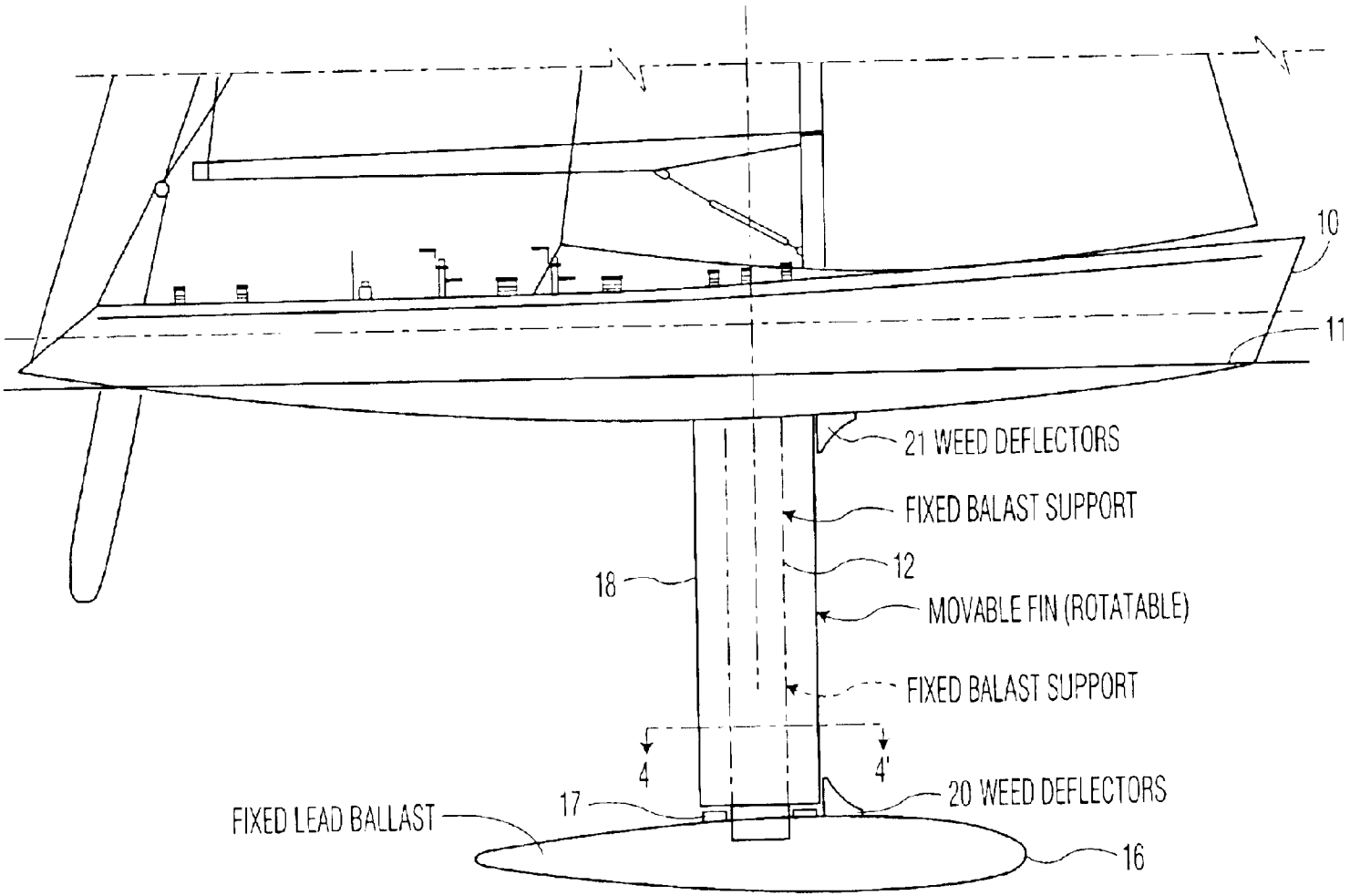
FIG. 3 illustrates a vertical view of a sailing yacht having an appendage according to the invention showing a ballast support member fixed to the canoe body and carrying a heavy ballast bulb at the end thereof, a fin with a desired thin thickness for maximizing its lift/drag ratio rotates about and jackets the ballast support member, the rotatable fin being supported upon the ballast bulb and showing the isolation of the ballast support member from moving water by the jacketed rotatable fin.
Figure 4:
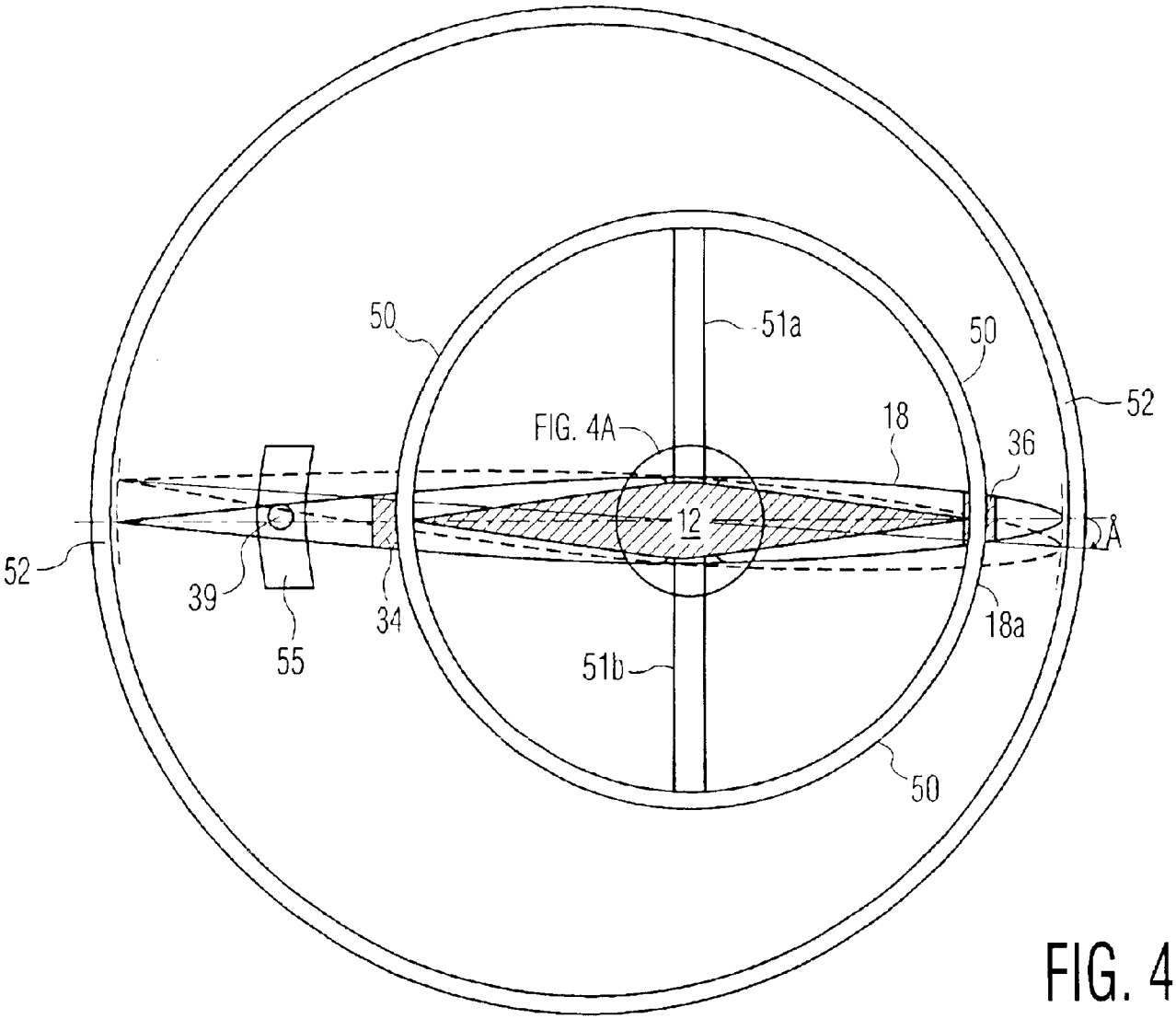
FIG. 4 is a plan view of the structure in FIG. 5 to illustrate the anchoring of the ballast support member to the interior of the canoe body and the physical positioning of the rotatable fin about the diamond shaped ballast support member which carries the rotatable fin.

In FIG. 3, a sailing vessel has a canoe body 10 with a water line 11 therearound. A four-sided diamond shaped ballast support member 12 is anchored to the cabin top and cabin sole in the interior of the canoe body 10 as shown in FIG. 5. A heavy ballast bulb 16 is attached to the bottom end of the diamond shaped ballast support 12. A thin fin 18 snugly jackets and is rotatable about the diamond shaped ballast support 12 up to a needed maximum angular displacement of A degrees, say +/−10°, as determined by the geometry of the configuration shown in FIGS. 4 and 4A. The rotatable fin 18 is supported by and rotatably slides upon a platform portion 17 located on the top of the ballast 16, the diamond shaped ballast support 12 being fixed to the interior of the canoe body 10 as shown in FIG. 5.

The strength and resistance to bending of the rotatable fin 18 is directly related to the length of its crossectional periphery and the polar moment of the jacketed unit consisting of the diamond shaped ballast support member 12 and the fin 18. The bending stresses are much higher in both the fin 18 and the ballast support member 12 when the tacking canoe body 10 is maximum heeled and is pitching and rolling in heavy seas with strong winds than the tensile stresses in the diamond shaped ballast support produced only by the downward weight of the 30,000 pound ballast bulb. The combination of the bending stresses and the tensile stresses have to be considered when designing the diamond shaped ballast support member 12.

A four sided diamond shape for the ballast support member 12 favorably can have both a long crossectional periphery and a large polar moment to reinforce both the ballast support member 12 and the fin 18 against breakage caused by the swinging heavy ballast bulb when the canoe body rolls and pitches (or by gravity alone acting on the heavy ballast bulb).

Compared to a circular shaft having a diameter which allows it to pass into the thin rotatable fin 18, or fixed to the top of thin fin 18, the circular shaft has a much shorter crossectional peripheral length and a much smaller polar moment which makes it weaker, more deflectable and not suited for racing yachts such as America's Cup Class yachts. In FIGS. 3 and 4, thin fin 18 completely envelops the ballast support member 12 to eliminate the wetted surface drag of the ballast support member 12 and thereby enhances yacht velocity.

To avoid canoe body breakages by the whipping motion of the heavy ballast bulb, forces transmitted to the canoe body by the whipping ballast support member unit are distributed to many interior canoe body surfaces and regions as shown in FIG. 5.

Since any clearance between the top of the rotatable fin 18 and the bottom of the canoe body 10 would cause undesirable turbulence and drag, the fin 18 extends above the cabin sole 48 and into the interior of the canoe body 10 where the diamond shaped ballast support member 12 and fin 18 are strongly supported by various reinforced portions of the cabin sole and the cabin top.

Desirably, weed deflectors 20,21 for the rotatable fin 18 can be fixed to the ballast 16 and canoe body 10, as shown in FIG. 3.

FIG. 4 is a plan view illustrating the physical positioning of the jacketing fin which is rotatable about the diamond shaped ballast support member as well as the support of the fixed diamond shaped member in the canoe body as shown in FIG. 5.

Figure 4A:
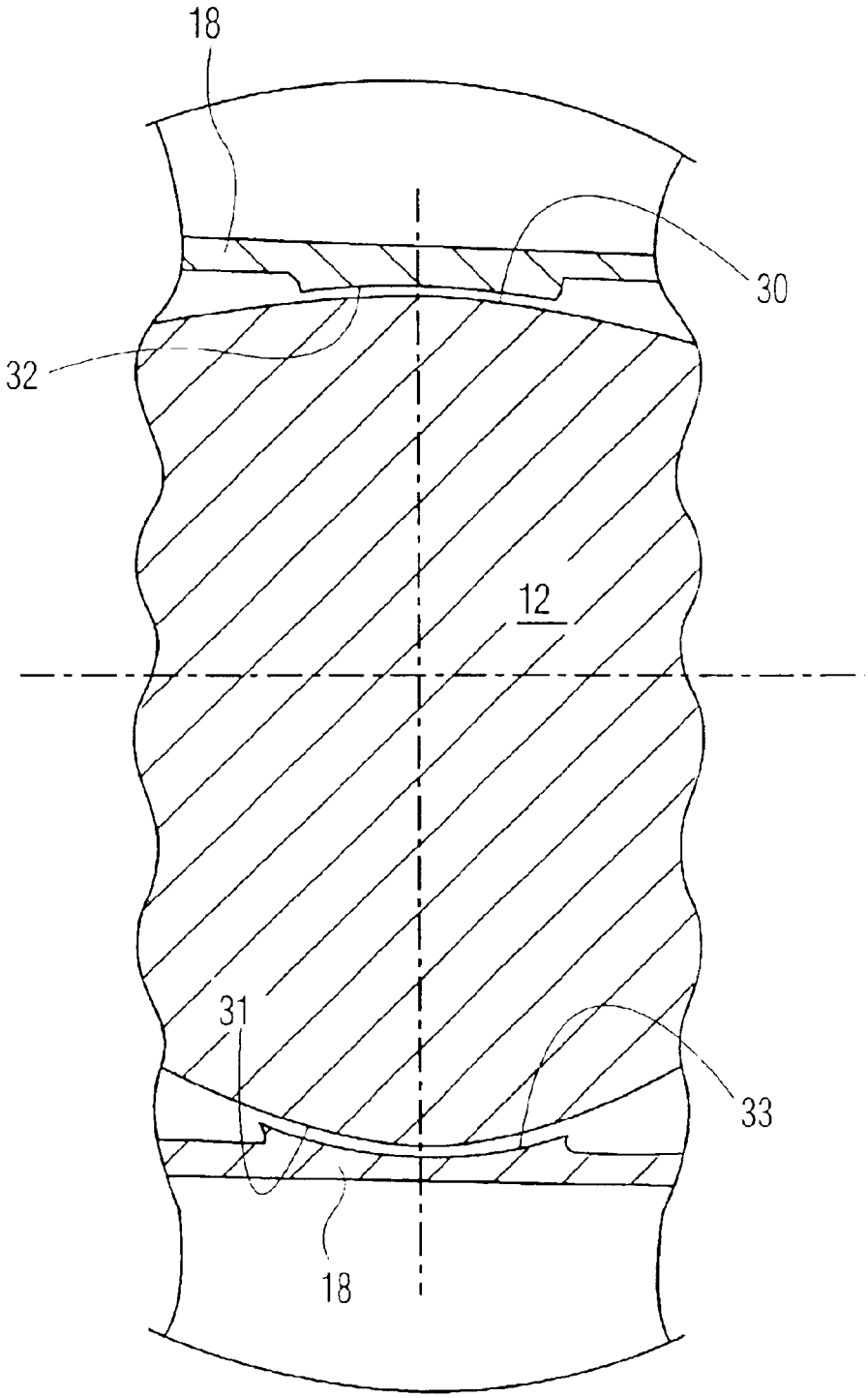
FIG. 4A is an exploded view of a portion of FIG. 4 in the region of the two minor apexes of the four sided diamond shaped ballast support member and the rotatable fin therearound.
Figure 5:
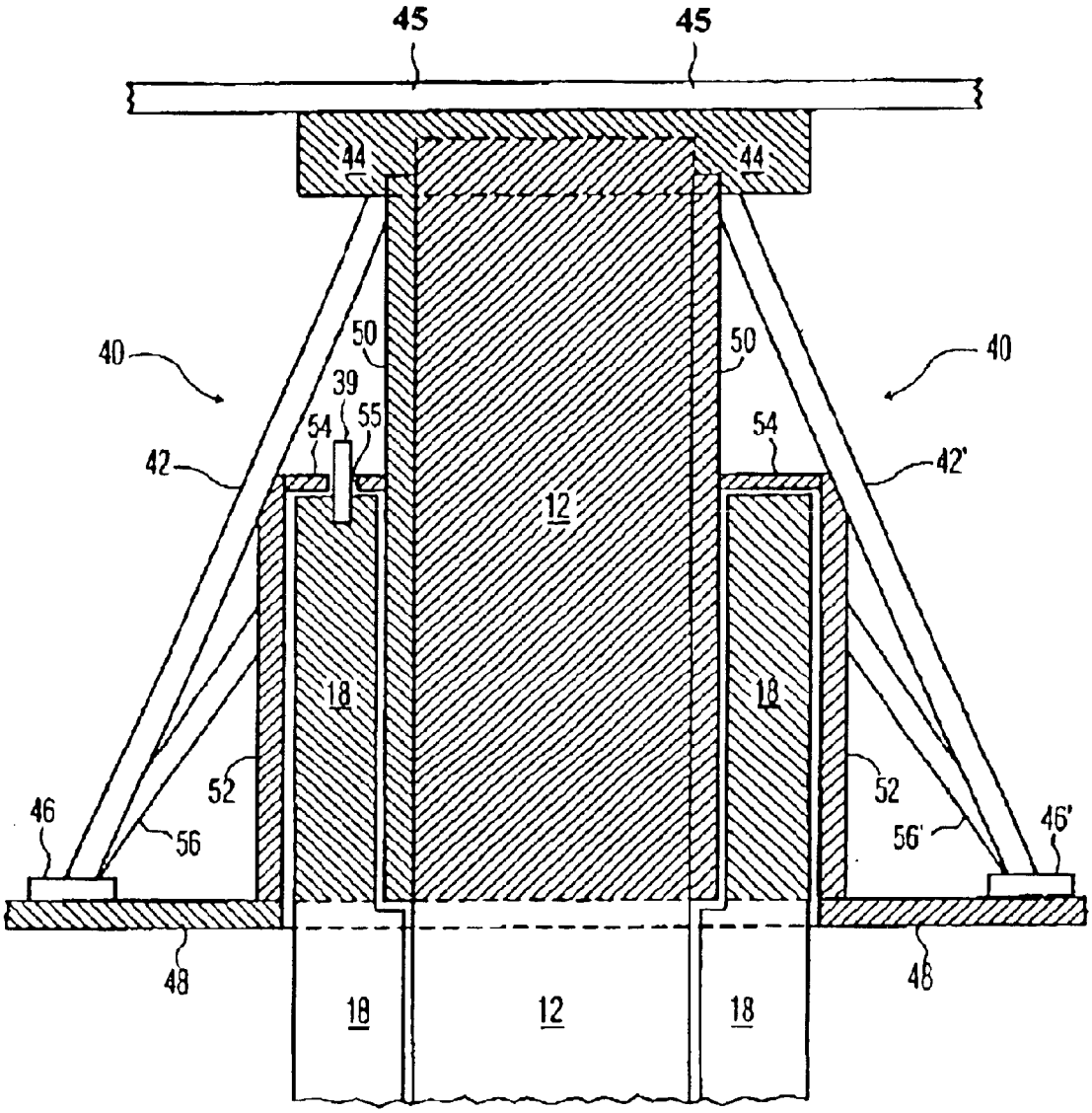
FIG. 5 illustrates an embodiment according to the invention showing the strong anchoring of the diamond shaped support carrying the heavy ballast bulb to the cabin top and cabin sole, the fin being rotatable around the diamond shaped ballast support.

As illustrated in FIG. 4 and FIG. 4A, the four sided diamond shaped ballast support 12 has convex surfaces 30,31 on the two opposite minor apexes thereof. Along its span, the rotatable fin 18 has concave interior surfaces 32,33 to mate with and have a low friction sliding motion with the convex surfaces 30,31 of the diamond shaped ballast support 12. Also, the four sides of the diamond shaped ballast support in FIG. 4 are preferably slightly rounded as shown in FIG. 4A. Such design provides mechanical strength for the rotatable fin 18 as it rotates +/−Å degrees around the two convex minor apexes 30,31 of the diamond shaped ballast support member 12. FIG. 4A, as illustrated, shows a slight space between mating surfaces 30 and 32 and a slight space between mating surfaces 31 and 33 to accommodate a bearing member (not shown) between each pair of concave/convex sliding surfaces. The rotatable fin 18 is further strengthened by interior blocks 34 and 36 located where they do not interfere with the major apexes of the diamond shaped ballast support member 12 when the fin 18 is angularly rotated.

After the maximum desired angular displacement Å of the fin 18 is specified by the Naval Architect, the geometric dimensions of the four sided diamond can be determined for the ballast support member 12 so that the fin 18 can be angularly displaced Å degrees, as shown in FIG. 4. The fin 18 will have a maximum angular clockwise displacement in FIG. 4 when the inside bottom surface of its forward portion touches the bottom outside surface of the forward portion of the diamond shaped ballast support member 12.

FIG. 5 illustrates the support in the interior of the canoe body 10 of the combined unit of the diamond shaped ballast support 12 carrying the heavy ballast bulb 16 at the bottom end thereof and the relatively light weight fin 18, rotatable fin 18 being supported on the platform 17 of the ballast bulb 16 as shown in FIG. 3. A vertical shaft 39 anchored in the top of the aft end of the rotatable fin 18 controls the angular displacement A of the rotatable fin 18 by hydraulics or other known mechanism from the helmsman's position.

As shown in FIG. 5, a structure 40 comprises a plurality of diagonal struts 42,42' . . . , the tops of the plurality of the diagonal struts 42,42' . . . being secured to an anchor block 44 which is secured to the cabin top 45 and the bottom ends of the plurality of the diagonal struts 42,42' . . . , being anchored to members 46,46' . . . which are fixed to the cabin sole 48 in 360° directions. A cylindrical member 50 is fixed to the anchor block 44, to the top ends 42,42' . . . of structure 40 and to the cabin sole 48.

The ballast support member 12 enters into the interior of cylindrical member 50, the two longest diagonally opposite apexes of the diamond shaped member 12 being anchored to the interior of the cylindrical member 50 for anchoring the support member 12 to the interior of cabin 10. Spokes 51*a* and 51*b* in FIG. 4 are fixed above the platform 54 between the interior walls of the cylindrical member 50 and the opposite two minor apexes of the ballast support member 12 to improve the support of the ballast support member 12 in the abeam direction.

A cylindrical member 52 having a internal surface with a diameter slightly greater than the diameter of the fin 18 closely surrounds the rotatable fin 18. Cylindrical member 52 is fixed to cylindrical member 50 by a platform 54 between members 52 and 50, to diagonal members 42,42' . . . of structure 40 and to the cabin sole 48. Diagonal struts 56,56' . . . are fixed to the cabin sole anchors 46,46' . . . and to member 52. An arcuate slot 55 is located in platform 54 to permit an arcuate movement of Å degrees, say +/−10° of the shaft 39 which controls the angular displacement of the fin 18. All structural members in FIGS. 3, 4 and 5 are preferably constructed of layered carbon fiber.

The structure illustrated and described in FIG. 5 provides wide distribution of the loads and stresses upon the diamond shaped ballast support member 12 and fin 18 to many surfaces of the cabin top and the cabin sole so as to avoid concentrated stresses which could damage and destroy the canoe body 10 as it yaws, rolls and pitches in strong winds and heavy seas.

The cabin top area near the anchor block 44 and the cabin sole areas near cylinders 50,58 and the plurality of anchor blocks 46,46' . . . can desirably be fiberglass reinforced.

The ballast bulb 16 can be pinned or bolted to its support member 12 so that in dry dock when the pins or bolts are removed, the ballast bulb 105 can be removed downwardly from the canoe body 10 for removal and installation of a different fin 18 and/or a different ballast bulb 16 and thereby the fin 18 can be selectively changed between races along with a different ballast bulb 16 as wind, sea and racing conditions change.

To establish the required compliance in INTERNAIONAL AMERICA'S CUP CLASS RULE, Version 4.0, Article 19.9(a) the rudder and the fin can move only in a rotational manner, as shown and described in this specification.

To establish the required compliance in INTERNAIONAL AMERICA'S CUP CLASS RULE, Version 4.0, Article 19.9(b), the vertical axis of the rotatable rudder and the vertical axis of the rotatable fin are in the vertical fore and aft plane of the hull, both axes having an angle greater than 45° to the plane of the waterline, as shown and described in this specification.

To establish the required compliance in INTERNAIONAL AMERICA'S CUP CLASS RULE, Version 4.0, Article 19.9(d), there is no increase in the righting moment nor change in the fore and aft trim nor infringement of Racing Rule 51 (Moving Ballast) and 42 (Propulsion) as the fin and rudder are rotated, as shown and described in this specification.

To establish the required compliance in INTERNAIONAL AMERICA'S CUP CLASS RULE, Version 4.0, Article 19.9(h) "Appendages which are ballast shall not rotate.", the rotatable fin 18 is not ballast and the only ballast is the ballast bulb which is fixed to the canoe body, as shown and described in this specification.

Accordingly, the embodiment of FIGS. 3, 4 and 5 is allowable for the construction of International America's Cup Class Yachts entered in the 2003 Race.

Suggested Fin Shapes

Useful shapes of wing sections have been developed, coded by NACA and published in "Theory of Wing Sections" by Abbott and Von Doenhoff, Dover Publications. NACA has developed many shapes for very high speed air craft flying in air medium and some NACA sections developed for aircraft are useful for applicants appendages in which keel fins move in a incompressible water medium. At very high aircraft speeds, the impinging air medium upon its wings approaches incompressible.

A few published NACA wing shapes which are useful for the applicants fin symmetrical shapes are:

1. NACA 63 A012
2. NACA 63 A015
2. NACA 0010-35
3. NACA 0009
4. NACA 0010

By naval architectural calculations, tow tank testing and sea trials, improvements in the embodiment of this specification can be determined by experimentation for maximum performance of the sailing vessel.

While there has been described and illustrated the fundamental novel features of the invention as applied to a preferred embodiment, it will be understood that various omissions and substitutions and changes in the form and details of the illustrated keel for a Sailing Vessel and it's construction may be made using equivalents by those skilled in the art, without departing from the spirit and concepts of the invention.

We claim:

1. A keel appendage comprising an elongated four-sided symmetrical diamond shaped ballast support member adapted to be fixed at its upper end to a canoe body in perpendicular relationship to the longitudinal axis of said canoe body, a ballast member fixed to the outer end of said ballast support member, the leading and trailing edges of said ballast support member being pointed and disposed perpendicular to the longitudinal axis of said canoe body, a hollow hydrodynamic fin completely surrounding said ballast support member and having a constant crossectional shape from its leading edge to its trailing edge as it is rotated in sliding contact with such ballast support member whereby the undesirable dynamic drag of the ballast support member is eliminated when the canoe body is sailing.

2. A keel appendage according to claim 1 wherein said rotatable fin extends from the top of said ballast member and enters into the interior of said canoe body whereby turbulence is reduced at the region where the rotatable fin enters the interior of the canoe body.

3. A keel appendage according to claim 2 wherein said rotatable fin is rotatably supported on a top surface of said ballast member.

4. A keel appendage according to claim 3 wherein the ballast support member has a major axis parallel to the longitudinal axis of the canoe body and a shorter minor axis perpendicular to said major axis, the two spaced corners on said minor axis of said four-sided elongated symmetrical diamond shaped ballast support each has a convex sliding surface and the interior of said rotatable fin has two concave sliding surfaces each of which mates with one of the convex sliding surfaces of said diamond support member.

5. A keel appendage according to claim 4 including a first cylindrical member fixed at its bottom end to the cabin sole of the interior of the canoe body and at its top end to the cabin top of the canoe body, said ballast support member at its two pointed corners on its major axis being fixed to the interior of said first cylindrical member.

6. A keel appendage according to claim 5 including a second cylindrical member fixed to said first cylinder member and to the sole of the canoe body, the interior of said second cylinder surrounding without touching the leading and trailing edges of said rotatable fin and means rotating said rotatable fin from the inside of said canoe body.

7. A keel appendage according to claim 6, wherein said rotatable fin means includes a pin fixed to the top of said rotatable fin and movably extends through an arcuate opening in the top of said second cylinder member and means selectively moving said pin whereby the angle of attack of said rotatable fin to the water truck is selectively adjusted.

8. A keel appendage according to claim 7 wherein said canoe body has a waterline therearound and said first and second cylindrical members are anchored in the cabin interior with their axes perpendicular to the plane of the canoe body waterline.

9. A keel appendage according to claim 8 including a plurality of diagonal members surrounding said first and second cylindrical members fixed at their lower ends to said cabin sole and fixed at the their top ends to said cabin top, and means anchoring said first and second cylindrical members to the plurality of said diagonal members.

10. A sailing vessel according to claim 1 wherein the shape of said rotatable fin is selected to generate a hydrodynamic force when its rotatable fin is pointed at an angle to the water track for countering the wind force that is drifting the canoe body leewardly, the net leeward wind force reducing the leeward drift distance of the canoe body and thereby reducing the leeward wasted drift energy of the canoe body, the savings in said leeward wasted drift energy being transferred to the portion of the wind energy which propels the canoe body forwardly in accordance with the Laws of Thermodynamics in accordance with the following formula:

$$We=(Fe+Fe')+(Le-Le')+He+Ke+Te-Ebs-Ebw-Ecw \quad (2),$$

where

We=Energy of the wind transferred to the canoe body,

Fe=Energy of the wind which forwardly propels the sailing vessel when the canoe body is pointing at an angle to the apparent wind, Fe'=Incremental energy available to increase the forward velocity of the canoe body with the energy saved when the leeward drift of the canoe body 18 reduced, Le=Energy wasted by the canoe body drifting leewardly by the wind when the keel is not making leeway, Le'=Leeward drift enemy wasted by the canoe body drifting leewardly when the keel is making leeway, He=Energy wasted by drag of the canoe body when it is not Pointing into the water track and tacking, Ke=Keel induced wasted drag when it is making leeway, Ebs=Energy saved when the support members of the ballast bulb has no wetted surfaces, Ebw=Energy saved when the bow wave is eliminated, Ecw=Energy saved when the canoe body has no crabwise motion, Te=Total Entropy lost energy by the energy transfers when the keel is making leeway, whereby the forward velocity of the canoe body is increased when:(a) the leeward drift of the canoe body is reduced by the asymmetrical effect of the fin; (b) the energy saved of Ebw+Ecw occurs as the canoe body is pointed directly into the water track; and (c) the support member of the ballast bulb has no wetted surfaces.

* * * * *